US010052896B2

(12) United States Patent
Yamaguchi

(10) Patent No.: US 10,052,896 B2
(45) Date of Patent: Aug. 21, 2018

(54) RECORDING APPARATUS, AND CLEANING METHOD OF RECORDING APPARATUS

(71) Applicant: SEIKO EPSON CORPORATION, Tokyo (JP)

(72) Inventor: Kenji Yamaguchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/113,936

(22) PCT Filed: Feb. 10, 2015

(86) PCT No.: PCT/JP2015/000615
§ 371 (c)(1),
(2) Date: Jul. 25, 2016

(87) PCT Pub. No.: WO2015/125440
PCT Pub. Date: Aug. 27, 2015

(65) Prior Publication Data

US 2016/0355037 A1 Dec. 8, 2016

(30) Foreign Application Priority Data

Feb. 21, 2014 (JP) ..... 2014-031417

(51) Int. Cl.
*B41J 29/17* (2006.01)
*D06B 11/00* (2006.01)
(Continued)

(52) U.S. Cl.
CPC ..... *B41J 29/17* (2013.01); *B41J 3/4078* (2013.01); *B41J 11/007* (2013.01); *B41J 13/12* (2013.01); *D06B 11/00* (2013.01)

(58) Field of Classification Search
CPC . B41J 11/007; B41J 29/17; B41J 13/12; B41J 3/4078; B65H 2301/511; B65H 2301/5115; B08B 1/02; D06B 11/00
See application file for complete search history.

(56) References Cited

U.S. PATENT DOCUMENTS 5,225,852 A * 7/1993 Uchida ..... B41J 2/16579 346/104
5,526,028 A * 6/1996 Rottman ..... B41J 11/007 347/102
(Continued)

FOREIGN PATENT DOCUMENTS

DE 19860567 A1 * 6/2000 ..... D21F 1/32
EP 1160091 A1 12/2001
(Continued)

OTHER PUBLICATIONS

The Extended European Search Report for the corresponding European Patent Application No. 15752730.0 dated Feb. 15, 2018.

*Primary Examiner* — Sharon A Polk

(57) ABSTRACT

There is provided a recording apparatus which includes a transporting belt on which a recording medium and which transports the recording medium and performs efficient cleaning of the transporting belt without an excess cleaning. The recording apparatus (printing apparatus) includes a recording section performing recording by applying liquid (ink) to a recording medium (fabric), a transporting belt transporting the recording medium, and a cleaning section having a plurality of cleaning units cleaning the transporting belt. A cleaning unit which is selected in accordance with a cleaning requirement level operates.

10 Claims, 3 Drawing Sheets

(51) Int. Cl.

| | |
|---|---|
| ***B41J 3/407*** | (2006.01) |
| ***B41J 11/00*** | (2006.01) |
| ***B41J 13/12*** | (2006.01) |

(56) References Cited

U.S. PATENT DOCUMENTS

| | | | | |
|---|---|---|---|---|
| 5,845,174 | A * | 12/1998 | Yasui | G03G 15/166 399/101 |
| 6,698,878 | B1 * | 3/2004 | Roche | B41J 11/007 134/9 |
| 6,775,512 | B2 * | 8/2004 | Thayer | G03G 21/0035 399/353 |
| 7,731,348 | B2 * | 6/2010 | Mitsuhashi | B41J 11/007 271/193 |
| 9,067,444 | B2 * | 6/2015 | Momose | B41J 29/17 |
| 9,199,496 | B2 * | 12/2015 | Hobo | B41J 11/007 |
| 2001/0028372 | A1 | 10/2001 | Yoshimura | |
| 2003/0063174 | A1 * | 4/2003 | Kanome | B41J 11/007 347/104 |
| 2005/0168521 | A1 * | 8/2005 | Suzuki | B41J 3/4078 347/33 |
| 2006/0238596 | A1 | 10/2006 | Mitsuhashi et al. | |
| 2008/0225068 | A1 * | 9/2008 | Morino | B41J 2/2135 347/14 |
| 2009/0092404 | A1 * | 4/2009 | Tashiro | B41J 11/003 399/38 |
| 2011/0234662 | A1 | 9/2011 | Tsuchiya | |
| 2011/0242152 | A1 * | 10/2011 | Takeda | B41J 29/17 347/1 |

FOREIGN PATENT DOCUMENTS

| | | | | |
|---|---|---|---|---|
| EP | 1162074 | A1 * | 12/2001 | B41J 11/007 |
| EP | 1559568 | A2 | 8/2005 | |
| EP | 1560080 | A1 | 8/2005 | |
| JP | 11-192694 | A | 7/1999 | |
| JP | 2005-212277 | A | 8/2005 | |
| JP | 2011-073813 | A | 4/2011 | |
| JP | 2011-206937 | A | 10/2011 | |
| WO | 2010/023771 | A1 | 3/2010 | |

* cited by examiner

RECORDING APPARATUS, AND CLEANING METHOD OF RECORDING APPARATUS

CROSS-REFERENCE TO RELATED APPLICATIONS

This U.S. National stage application of International Patent Application No. PCT/JP2015/000615, filed on Feb. 10, 2015, which, in turn, claims priority under 35 U.S.C. § 119(a) to Japanese Patent Application No. 2014-031417, filed in Japan on Feb. 21, 2014, the entire contents of which are hereby incorporated herein by reference.

TECHNICAL FIELD

The present invention relates to a recording apparatus including a transporting belt for transporting a recording medium and a cleaning method of the recording apparatus.

BACKGROUND ART

A recording apparatus including a transporting mechanism on which a recording medium is mounted on an endless transporting belt and which transports the mounted recording medium has been used. In such a recording apparatus, an ink is dropped out of an end portion of a recording medium to be attached to a surface of the transporting belt in some cases when recording is performed on the end portion of the recording medium. When a material having high ink permeability such as a fabric is used as a recording medium, the ink is exuded from a surface (recording surface) of the recording medium to a back surface thereof and the exuded ink is attached to the surface of the transporting belt in some cases.

Regarding this, for example, PTL 1 discloses a recording apparatus including a cleaning section having a wiping roller of which the peripheral surface is formed from a polymeric porous material in order to clean a surface of a transporting belt.

PTL 2 discloses an image recording apparatus in which a plurality of cleaning rollers for cleaning a transporting belt is provided and a cleaning fluid for removing contaminants wiped off by a cleaning roller on a downstream side is used for cleaning a cleaning roller on an upstream side, and thus it is possible to efficiently use the cleaning fluid.

CITATION LIST

Patent Literature

PTL 1: JP-A-11-192694
PTL 2: JP-A-2005-212277

SUMMARY OF INVENTION

Technical Problem

However, since a cleaning method or a degree of cleaning is not changed when cleaning of the transporting belt is unnecessary and when the transporting belt is in a few good state, depending on a type of recording medium, a specification (a size or a position of an image, an image quality, a type of the ink, and the like) of the image to be recorded, cleaning may be performed excessively or wastefully in the recording apparatuses disclosed in PTL 1 and PTL 2. As a result, there is a problem in that the surface of the transporting belt is caused to deteriorate rapidly, or cleaning water or power necessary for cleaning is wasted.

Solution to Problem

The invention has been made to solve at least a part of the above-described problem and can be implemented as the following application examples or embodiments.

Application Example 1

A recording apparatus according to an application example includes: a recording section which performs recording by applying liquid to a recording medium, a transporting belt which transports the recording medium, and a cleaning section which has a plurality of cleaning units for cleaning the transporting belt, in which a cleaning unit selected in accordance with a cleaning requirement level operates.

The recording apparatus of the application example includes the recording section which performs recording by applying liquid to a recording medium, the transporting belt which transports the recording medium, and the cleaning section which has the plurality of cleaning units for cleaning the transporting belt. A cleaning unit selected in accordance with a cleaning requirement level operates. Accordingly, according to the application example, since a cleaning unit operates in accordance with a cleaning requirement level, it is possible to perform cleaning in a necessary and sufficient range. In other words, when a surface (a surface on which the recording medium is mounted) of the transporting belt is maintained to be sufficiently clean, a state is possible in which no cleaning units operate. As a result, cleaning of the transporting belt is not performed excessively or wastefully, and rapid deterioration of the surface of the transporting belt or waste of cleaning water or power necessary for cleaning is suppressed.

Application Example 2

In the recording apparatus according to the application example, the cleaning requirement level is based on an attribute of the recording medium or an attribute of the liquid.

According to the application example, the cleaning requirement level is based on an attribute of the recording medium or an attribute of the liquid. An amount of the liquid which penetrates the recording medium and is exuded to the transporting belt varies depending on an attribute of the recording medium such as a material of the recording medium and characteristics of the recording medium or an attribute of the liquid such as a material of the liquid and characteristics of the liquid. Accordingly, according to the application example, since the cleaning requirement level is based on information regarding these, it is possible to perform cleaning in a necessary and sufficient range. As a result, cleaning of the transporting belt is not performed excessively or wastefully, and rapid deterioration of the surface of the transporting belt or waste of cleaning water or power necessary for cleaning is suppressed.

Application Example 3

In the recording apparatus according to the application example, the cleaning requirement level is based on image data recorded on the recording medium.

According to the application example, since the cleaning requirement level is based on the image data recorded on the recording medium, that is, a position to which the liquid is applied and an amount of the applied liquid, a cleaning unit selected in accordance with a state (a position or an amount) of the liquid which penetrates the recording medium and is exuded to the transporting belt operates. Accordingly, it is possible to further efficiently perform cleaning in a necessary and sufficient range. As a result, cleaning of the transporting belt is not performed excessively or wastefully, and rapid deterioration of the surface of the transporting belt or waste of cleaning water or power necessary for cleaning is suppressed.

Application Example 4

In the recording apparatus according to the application example, the cleaning requirement level is based on a consumption amount of the liquid.

According to the application example, the cleaning requirement level is based on a consumption amount of the liquid, that is, an amount of the liquid applied to the recording medium. When the amount of the liquid which penetrates the recording medium and is exuded to the transporting belt and the consumption amount of the liquid have a correlation, a cleaning unit selected in accordance with the amount of the liquid exuded to the transporting belt operates. Accordingly, it is possible to perform cleaning in a necessary and sufficient range. As a result, cleaning of the transporting belt is not performed excessively or wastefully, and rapid deterioration of the surface of the transporting belt or waste of cleaning water or power necessary for cleaning is suppressed.

Application Example 5

The recording apparatus according to the application example further includes an input section to which an attribute of the recording medium and/or an attribute of the liquid is input.

The recording apparatus of the application example further includes the input section to which an attribute of the recording medium and/or an attribute of the liquid is input. The amount of the liquid which penetrates the recording medium and is exuded to the transporting belt varies depending on an attribute of the recording medium such as a material of the recording medium and characteristics of the recording medium or an attribute of the liquid such as a material of the liquid and characteristics of the liquid. According to the application example, since the cleaning requirement level is based on information regarding these, a cleaning unit selected in accordance with a state of the liquid which penetrates the recording medium and is exuded to the transporting belt operates. Accordingly, it is possible to perform cleaning in a necessary and sufficient range. As a result, cleaning of the transporting belt is not performed excessively or wastefully, and rapid deterioration of the surface of the transporting belt or waste of cleaning water or power necessary for cleaning is suppressed.

Application Example 6

In the recording apparatus according to the application example, an attribute of the recording medium includes a weight and/or a density of the recording medium and an attribute of the liquid includes a type of the liquid.

According to the application example, an attribute of the recording medium includes a weight and/or a density of the recording medium and an attribute of the liquid includes a type of the liquid. The amount of the liquid which penetrates the recording medium and is exuded to the transporting belt varies depending on the weight or the density of the recording medium and the type of the liquid. A cleaning ability (ease of removing contaminants) of the liquid attached to the transporting belt varies depending on the type of the liquid. According to the application example, since the cleaning requirement level is based on an attribute of the recording medium or an attribute of the liquid including information regarding these, a cleaning unit selected in accordance with a state of the liquid which penetrates the recording medium and is exuded to the transporting belt or the cleaning ability operates. Accordingly, it is possible to perform cleaning in a necessary and sufficient range. As a result, cleaning of the transporting belt is not performed excessively or wastefully, and rapid deterioration of the surface of the transporting belt or waste of cleaning water or power necessary for cleaning is suppressed.

Application Example 7

In the recording apparatus according to the application example, the cleaning section has a sensor for detecting a surface state of the cleaned transporting belt, and the cleaning requirement level is based on a result obtained by detection of the sensor.

According to the application example, the cleaning section has the sensor for detecting a surface state of the cleaned transporting belt. The cleaning requirement level is based on a result obtained by detecting of the sensor. Since the cleaning requirement level is based on the surface state of the transporting belt detected by the sensor, the cleaning unit to operate is selected in accordance with contaminants (attachment state of the liquid) of the transporting belt. Accordingly, it is possible to perform cleaning in a necessary and sufficient range. As a result, cleaning of the transporting belt is not performed excessively or wastefully, and rapid deterioration of the surface of the transporting belt or waste of cleaning water or power necessary for cleaning is suppressed.

Application Example 8

In the recording apparatus according to the application example, the plurality of cleaning units are disposed respectively in a direction in which the transporting belt moves and a direction intersecting the direction in which the transporting belt moves.

According to the application example, since the plurality of cleaning units are disposed in the direction in which the transporting belt moves, it is possible for a cleaning unit positioned on a downstream side to perform further cleaning, for example, though cleaning is not completed by a cleaning unit positioned on an upstream side. Since the plurality of cleaning units are also disposed in the direction intersecting the direction in which the transporting belt moves, that is, a width direction of the transporting belt, a cleaning unit corresponding to a position of contaminants operates and thus it is possible to perform necessary cleaning, for example, when there are contaminants on only one side in the width direction of the transporting belt. That is, it is possible for the cleaning units to operate independently corresponding to the position of contaminants. As a result, cleaning of the transporting belt is not performed excessively or wastefully, and rapid deterioration of the surface of the transporting belt or waste of cleaning water or power necessary for cleaning is suppressed.

Application Example 9

A cleaning method of a recording apparatus according to the application example is a cleaning method of a recording apparatus including a recording section performing recording by applying liquid to a recording medium, a transporting belt transporting the recording medium, and a cleaning section having a plurality of cleaning units cleaning the transporting belt, and the cleaning method of the recording apparatus causes a cleaning unit to selectively operate in accordance with a cleaning requirement level.

The cleaning method of a recording apparatus of the application example is a cleaning method of the recording apparatus including the recording section which performs recording by applying liquid to a recording medium, the transporting belt on which a recording medium is mounted and which transports the recording medium, and the cleaning section which has a plurality of cleaning units cleaning the transporting belt. According to the application example, a cleaning unit is caused to selectively operate in accordance with a cleaning requirement level. Accordingly, when a surface (a surface on which the recording medium is mounted) of the transporting belt is maintained to be sufficiently clean, a state is possible in which no cleaning units operate. Since a cleaning unit operates in accordance with the cleaning requirement level, it is possible to perform cleaning in a necessary and sufficient range. As a result, cleaning of the transporting belt is not performed excessively or wastefully, and rapid deterioration of the surface of the transporting belt or waste of cleaning water or power necessary for cleaning is suppressed.

DESCRIPTION OF EMBODIMENTS

Hereinafter, embodiments exemplifying the invention will be described with reference to the drawings. The invention is not limited to the following one embodiment of the invention. The drawings may illustrate with a scale different from that in practice in order to make the explanation easily understandable. A Z axis direction refers to as a vertical direction and a Z direction refers to an upward direction. A Y axis direction refers to a front-rear direction and a +Y direction refers to a front-side direction. An X axis direction refers to a horizontal direction and a +X direction refers to as a left-side direction. An X-Y plane refers to as a horizontal plane.

Embodiment 1

Figure 1:
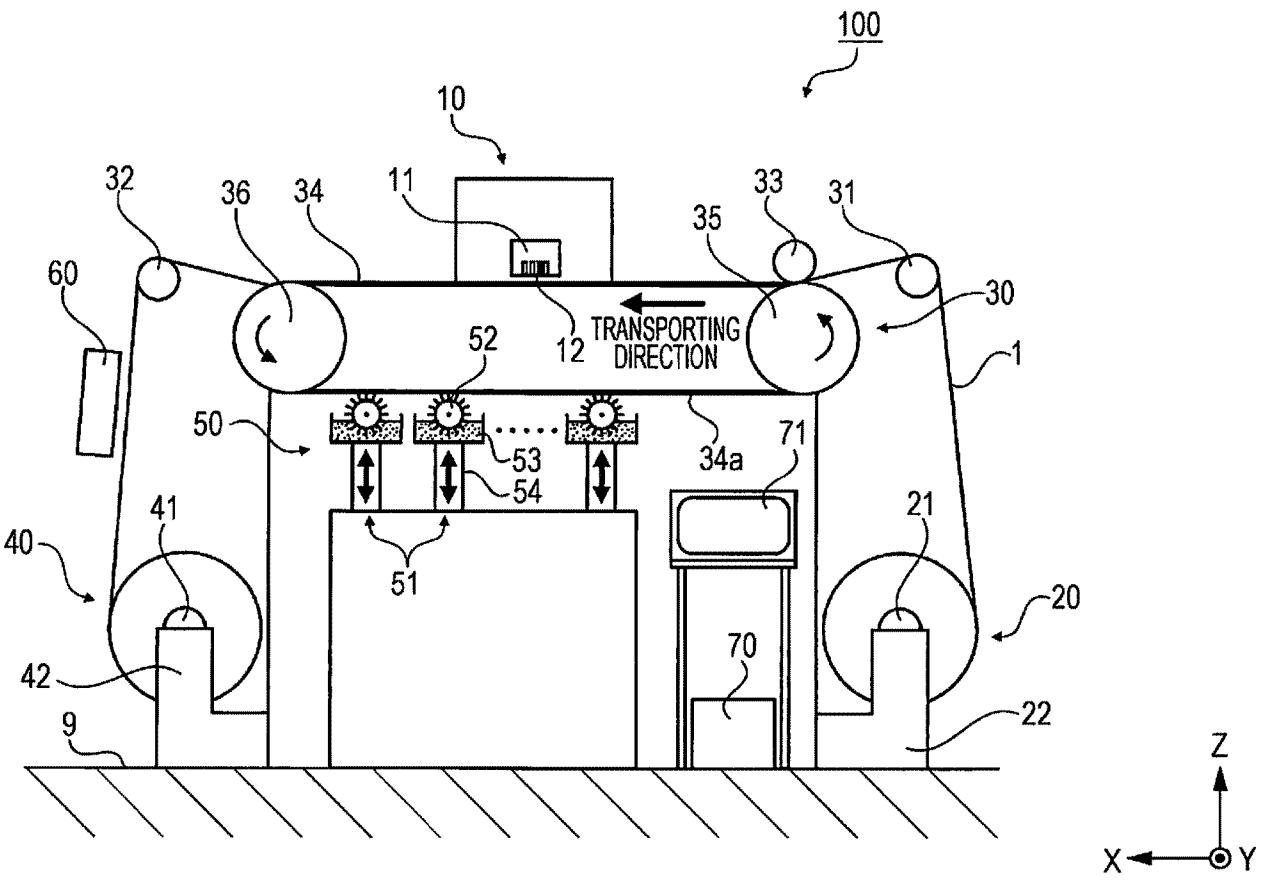
FIG. 1 is a schematic diagram illustrating a printing apparatus as a "recording apparatus" according to Embodiment 1.

FIG. 1 is a schematic diagram illustrating a printing apparatus 100 as a "recording apparatus" according to Embodiment 1.

The printing apparatus 100 is a recording apparatus for performing printing on a fabric 1 by applying an ink as "liquid" to the fabric 1 as a "recording medium" to print (record) an image.

The printing apparatus 100 includes a recording section 10, a supplying section 20, a transporting section 30, a retrieving section 40, a cleaning section 50, a drying section 60, a control section 70, and the like.

For example, fabrics such as cotton, silk, wool, a chemical-fiber fabric, and blended fabrics are used as the fabric 1. In the embodiment, a configuration in a case of printing an image on a band-shaped fabric supplied by using a roll method will be described as an example, but the embodiment is not limited to this. As long as there is a recording apparatus which uses a transporting belt for transporting a recording medium, other configurations (for example, a configuration using a sheet type recording medium as a target) may be applied.

The recording section 10 includes an ink ejecting head 11 for forming and printing (recording) an image by ejecting an ink through an ink jet method and applying the ink to the fabric 1. The ink ejecting head 11 has, for example, four nozzle rows 12 and ejects inks (for example, cyan: C, magenta: M, yellow: Y, black: K) with different colors for each nozzle row 12.

The ink ejecting head 11 is a line head type ink ejecting head which is fixed and arranged extending in a width direction of the fabric 1. In addition, the ink ejecting head 11 may be any one of serial type ink ejecting heads which are mounted in a movable carriage, and eject ink while moving in the width direction of the fabric 1.

The supplying section 20 includes a shaft portion 21 for supporting the fabric 21 wound up in a roll shape and a bearing portion 22 for supporting the shaft portion 21 such that the supplying section 20 is detachable and rotatable. The supplying section 20 stores the fabric 1 before the ink is ejected, that is, the fabric 1 on which a desired image is not formed (printed).

The bearing portion 22 includes a rotation driving unit (not illustrated) for causing the shaft portion 21 to rotary-drive and causes the shaft portion 21 to rotate in a direction in which the fabric 1 is delivered. The control section 70 controls operation of the rotation driving unit. When the fabric 1 is stably pulled out by the transporting section 30, the rotation driving unit may not be required.

The transporting section 30 transports the fabric 1 along a transporting path from the supplying section 20 to the retrieving section 40 through the recording section 10. The transporting section 30 includes transporting rollers 31 and 32, a fabric pressing roller 33, a transporting belt 34, a belt rotated roller 35, a belt driving roller 36, and the like.

The transporting belt 34 is formed in an endless form and is suspended on the belt rotated roller 35 and the belt driving roller 36. That is, the belt rotated roller 35 and the belt driving roller 36 supports an inner surface of the transporting belt 34.

The transporting belt 34 is held in a state where predetermined tension acts such that portions between the belt rotated roller 35 and the belt driving roller 36 are parallel with a floor 9. A configuration in which a support for supporting the transporting belt 34 from the inner surface is provided between the belt rotated roller 35 and the belt driving roller 36 may be also applied.

An adhesive layer (not illustrated) for adhering the fabric 1 is provided on a surface (support surface 34*a*) of the transporting belt 34. The transporting belt 34 supports the fabric 1 on the support surface 34*a* on which the adhesive layer is provided. The fabric pressing roller 33 is installed above the transporting belt 34 on an upstream side of the transporting path above the recording section 10. The fabric pressing roller 33 presses the fabric 1 on the support surface 34*a* on which the adhesive layer is provided and prevents the fabric 1 from being separated (floating) from the transporting belt 34.

Rotation of the belt driving roller 36 causes the transporting belt 34 to rotate and the belt rotated roller 35 is rotated by rotating of the transporting belt 34. Rotation of the transporting belt 34 causes the fabric 1 supported on the transporting belt 34 (support surface 34*a*) to be transported in a predetermined transporting direction. The belt rotated roller 35 is disposed on an upstream side of the belt driving roller 36 in the transporting path. That is, a direction (+X direction in FIG. 1) from the belt rotated roller 35 to the belt driving roller 36 is a transporting direction.

The transporting roller 31 relays the fabric 1 on in a transporting path from the supplying section 20 to the fabric pressing roller 33. The transporting roller 32 separates the fabric 1 from the support surface 34*a* of the transporting belt 34 and relays the fabric 1 on in a transporting path from the drying section 60 to the retrieving section 40.

The drying section 60 is provided between the transporting roller 32 and the retrieving section 40 and dries the fabric 1 after ink is ejected by using a drying mechanism (for example, a heater or an ultraviolet irradiator) according to the type of the ink.

The retrieving section 40 includes a shaft portion 41 obtained by winding the band-shaped fabric 1 in a roll shape and a bearing portion 42 for supporting the shaft portion 41 such that the shaft portion 41 is detachable and rotatable. The retrieving section 40 stores the fabric 1 after the applied ink is dried, that is, after a desired image is formed.

The bearing portion 42 includes a rotation driving unit (not illustrated) for causing the shaft portion 41 to rotary-drive and causes the shaft portion 41 to rotate in a direction in which the fabric 1 is wound up. The control section 70 controls operation of the rotation driving unit.

The control section 70 is, for example, a personal computer including a display unit 71 and controls overall components of the printing apparatus 100. Specifically, the control section 70 performs control of the recording section 10 (ink ejecting control of the ink ejecting head 11) as recording control performed based on image data input in advance, performs transportation driving control and the like of the transporting section 30, or performs operating control and the like of the cleaning section 50 which will be described below.

Figure 2:
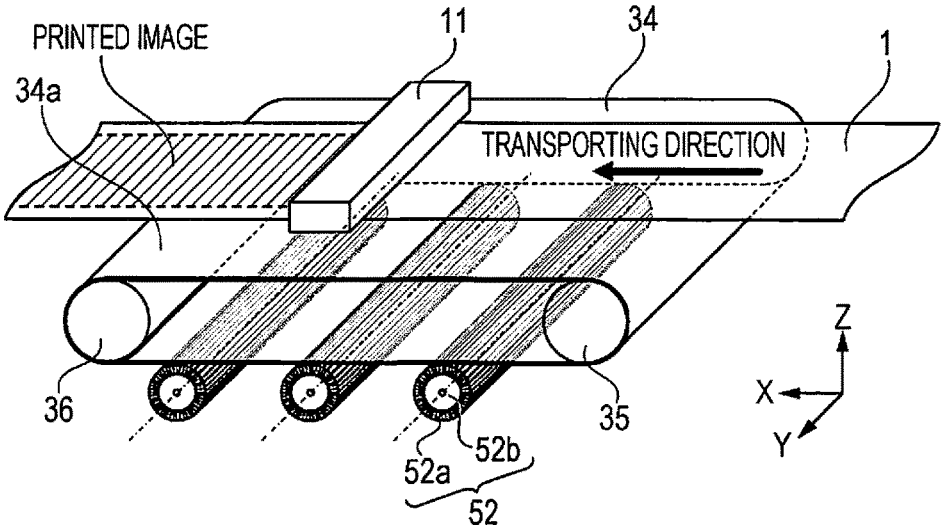
FIG. 2 is a perspective view illustrating a relationship between cleaning rollers included in a cleaning section and a transporting belt.

FIG. 2 is a perspective view illustrating a relationship between cleaning rollers 52 included in the cleaning section 50 and the transporting belt 34. The cleaning section 50 will be described with reference to FIG. 1 and FIG. 2.

The cleaning section 50 includes a plurality of cleaning units 51 which clean the surface (support surface 34*a*) of the transporting belt 34. The cleaning section 50 is positioned such that the transporting belt 34 suspended by the belt rotated roller 35 and the belt driving roller 36 is interposed between the cleaning section 50 and the recording section 10. The cleaning section 50 is disposed to clean the surface (support surface 34*a*) of the transporting belt 34 from a side underneath.

The plurality of cleaning units 51 are arranged from an upstream side to a downstream side in a direction in which the transporting belt 34 moves. Each of the cleaning units 51 includes a cleaning roller 52, a cleaning tank 53, a pressing mechanism 54, and the like.

The cleaning roller 52 is a rotating roller having a width the same as or a little wider than the width of the transporting belt 34. The cleaning roller 52 has a brush 52*a* cleaning the support surface 34*a*, a shaft portion 52*b* constituting a rotation shaft in a direction intersecting a direction (transporting direction) in which the transporting belt 34 moves, and the like. The shaft portion 52*b* is rotated by a driving motor (not illustrated), and thus the brush 52*a* abutting on the support surface 34*a* rotates to clean the support surface 34*a*.

A rotating direction of the cleaning roller 52 may be set for every position at which the cleaning units 51 are installed. It is preferable that a combination of the rotating direction, a rotation speed, or the like be appropriately set by evaluating a cleaning effect depending on operation control of the cleaning unit 51 which will be described later.

The cleaning tank 53 is a tank for storing a cleaning fluid for removing ink or other foreign materials attached to the brush 52*a* and performing cleaning. A lower portion (brush 52*a*) of the cleaning roller 52 is disposed to be exposed to the stored cleaning fluid.

The cleaning fluid is frequently supplied from a supplying port of the cleaning tank 53 and cleans the brush 52*a* and is discharged from a drainage port (not illustrated) during operation of the cleaning units 51. When the cleaning units 51 are not operating, supply and discharge of the cleaning fluid is stopped. Water or a water-soluble solvent (aqueous alcohol solution and the like) is used as the cleaning fluid.

The pressing mechanism 54 is a mechanism of supporting the shaft portion 52*b* of the cleaning roller 52 and the cleaning tank 53, and changing pressure of the cleaning roller 52 on the support surface 34*a* and adjusting the extent of cleaning by causing the shaft portion 52*b* and the cleaning tank 53 to move up and down. When the cleaning units 51 are not operating, the pressing mechanism 54 causes the brush 52*a* to move down to a height at which the brush 52*a* does not abut on the support surface 34*a* and causes the cleaning roller 52 to stop rotating.

The recording apparatus according to the embodiment has the above-described configuration in which the cleaning unit 51 which is selected in accordance with the cleaning requirement level operates. That is, the transporting belt 34 (support surface 34*a*) is maintained to be in a desired cleaned state by causing the cleaning units 51 of the plurality of cleaning units 51 in a necessary and sufficient range to operate in accordance with the necessity of cleaning the transporting belt 34 (support surface 34*a*).

The cleaning requirement level may be information indicating a degree of the necessity of cleaning and may be set by using various methods. Specific examples will be described below.

Example 1

A printing apparatus 100 according to Example 1 is a recording apparatus capable of selecting and setting a cleaning unit 51 to operate among the provided plurality of cleaning units 51. That is, the printing apparatus 100 of Example 1 is a recording apparatus having the most basic configuration in which the cleaning section 50 is operated in a manual mode by an operator.

The printing apparatus 100 of Example 1 may variably set a cleaning capacity of the cleaning sections 50 to be in a range between the weakest and the highest strength. For example, a cleaning execution level of the cleaning section 50 may be set to one of four levels which are strong, medium, weak, and unnecessary and the preset cleaning unit 51 operates with a preset specification with the cleaning capacity of the cleaning section 50.

For example, as illustrated in FIG. 2, when the cleaning section 50 is configured by three cleaning roller 52 (that is, three cleaning units 51), the strong cleaning execution level is set such that the three cleaning rollers 52 are in a full operation state (state in which the cleaning capacity is the strongest). The medium cleaning execution level is set in such a manner that two cleaning rollers 52 are in the full operation state and the weak cleaning execution level is set in such a manner that one cleaning roller 52 is in the full state.

The cleaning execution level refers to a level indicating an intensity of cleaning (cleaning capacity, cleaning effect), and intermediate levels may also be set between the respective levels in addition to these four levels (cleaning execution levels are strong, medium, weak, and unnecessary). The cleaning capacity varies greatly depending on, for example, the rotating direction of the cleaning roller 52, a rotating speed, a pressing force, and the like. Thus, intermediate levels may be set between the respective cleaning execution levels by using results of evaluating the cleaning effect in advance.

Regarding the cleaning requirement level (degree of the necessity of cleaning), an evaluation experiment is performed in advance before the printing apparatus 100 of Example 1 is operated and then a necessary and sufficient cleaning execution level is determined corresponding to results of the evaluation experiment. The evaluation experiment is performed based on an attribute of a recording medium scheduled to be used such as a type of the recording medium, a specification (size, position of an image or image quality) of the image printed (recorded) on the recording medium, and an attribute of an ink such as a type of ink. Recording may be performed in accordance with evaluation results, for example, by using a method in which when an image x is printed on a fabric 1*x* by using an ink x, the strong cleaning execution level is selected, when an image y is printed on a fabric 1*y* by using an ink y, the weak cleaning execution level is selected, and the like.

As described above, according to the recording apparatus and the cleaning method of the recording apparatus in the example of the embodiment, it is possible to obtain the following effects.

The cleaning unit 51 which is selected in accordance with the cleaning requirement level set by evaluating in advance operates. Since the cleaning unit 51 operates in accordance with the cleaning requirement level, it is possible to perform cleaning in a necessary and sufficient range. In other words, when the surface (support surface 34*a*) of the transporting belt 34 is maintained to be sufficiently clean, a state is possible in which the cleaning units do not operate. As a result, cleaning of the transporting belt 34 is not performed excessively or wastefully, and rapid deterioration (particularly, deterioration of an adhesive force in the adhesive layer) of the surface of the transporting belt 34 or waste of cleaning water or power necessary for cleaning is suppressed.

Example 2

Figure 3:
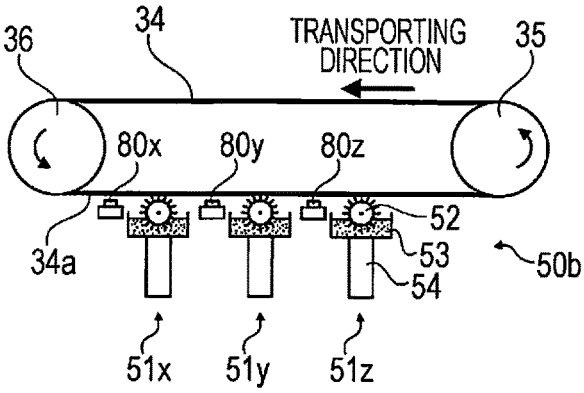
FIG. 3 is a schematic diagram illustrating the cleaning section of the printing apparatus according to Embodiment 1 (example 2).

FIG. 3 is a schematic diagram illustrating a cleaning section 50*b* of a printing apparatus 100 according to Example 2.

In the printing apparatus 100 of Example 2, the cleaning section 50*b* has sensors 80 for detecting the surface state of the transporting belt 34 to be cleaned for each cleaning unit 51 and the cleaning requirement level is based on results obtained by detecting of the sensors 80.

The cleaning section 50*b* includes, for example, three cleaning units 51 (51*x*, 51*y*, and 51*z*). The cleaning units 51 (51*x*, 51*y*, and 51*z*) respectively include the sensors 80 (80*x*, 80*y*, and 80*z*) provided on the upstream side from which the transporting belt 34 moves.

The sensor 80 is sensors detecting the surface state of the surface (support surface 34*a*) of the transporting belt 34. The sensor 80 is, for example, a line sensor which extends in the width direction of the transporting belt 34 to be able to detect the transporting belt 34 in the width direction and has a light source. The sensor 80 may obtain a state of the support surface 34*a* as a two-dimensional image with movement of the transporting belt 34. The image data obtained by the sensor 80 is transferred to the control section 70 and the control section 70 may perform image recognition to determine the state of the support surface 34*a*.

It is determined whether or not to operate the cleaning units 51 (51*x*, 51*y*, and 51*z*) positioned on the downstream side by using the image data obtained by the respective sensors 80 (80*x*, 80*y*, and 80*z*). That is, the cleaning unit 51 operates in only a case in which the surface state of the support surface 34*a* is determined to require for cleaning by the sensor 80.

Determination by using the image data of the support surface 34*a* obtained by the sensors 80 may be selection of the cleaning execution level (intermediate level depending on a difference between the cleaning rollers 52 in a rotating direction, a rotating speed, a pressing force, or the like) among the intermediate levels, in addition to operation/non-operation of the cleaning unit 51, similarly to a case of Example 1.

Since it is assumed that a cleaning ability (ease of removing contaminants) is low when an image indicating a state of the ink attached to the support surface 34*a* changes depending on the attributes of an ink scheduled to be used such as a type of ink, and when there are similar images, it is preferable that determination criteria of the image be set in advance and then confirmed in order to perform necessary and sufficient cleaning.

According to the recording apparatus and the cleaning method of the recording apparatus in the example, it is possible to obtain the following effects.

The cleaning section 50*b* has the sensors 80 for detecting the surface state of the cleaned transporting belt 34 for every cleaning unit 51. The cleaning requirement level is based on results of detection by the sensor 80. Since the cleaning requirement level is based on the surface state of the transporting belt 34 detected by the sensor 80, the cleaning unit 51 which is selected in accordance with contamination (attachment state of the ink) of the transporting belt 34 operates. Thus, it is possible to perform cleaning in a necessary and sufficient range. As a result, cleaning of the transporting belt 34 is not performed excessively or wastefully, and rapid deterioration of the surface of the transporting belt 34 or waste of cleaning water or power necessary for cleaning is suppressed.

Example 3

The printing apparatus 100 described in Example 1 includes a manual type cleaning section 50 in which the cleaning execution level is determined in accordance with the cleaning requirement level evaluated and set by the operator. The printing apparatus 100 described in Example 2 includes an automatic type cleaning section 50*b* in which the cleaning execution level of the cleaning unit 51 is automatically determined based on a detection result of the sensor 80.

Regarding a printing apparatus 100 of Example 3, if necessary information is input, the printing apparatus 100 of Example 3 selects a cleaning unit 51 to operate according to a preset condition table or determines the cleaning execution level at which the cleaning unit 51 is caused to operate in accordance with the determined cleaning execution level. The necessary information to be input is, specifically, attribute information of a recording medium (for example, fabric 1) and/or attribute information of liquid (ink) and is information closely associated with an amount of liquid which penetrates the recording medium and is exuded to the transporting belt 34.

Attributes of the recording medium include, for example, information on the transmittance of the liquid such as a material of the recording medium, a structure of the material, a thickness, a weight, and a density. Attributes of the liquid include, for example, information on the cleaning ability of the ink attached to the transporting belt 34 or on the transmittance in the recording medium such as a type, and a composition of the ink.

The transmittance of the liquid is information indicating a ratio of an amount of the liquid exuded to a back surface of the recording medium to an amount of the applied liquid per unit area to. Since an amount distribution of an ink applied to a recording medium is known based on image data to be printed, if the transmittance of the ink to the recording medium is understood, an amount of the ink exuded to the back surface and the position thereof may be estimated (calculated).

For example, if the material has a quality (transmittance=0) in which exuding of the ink to the back surface of the recording medium is not concerned, the cleaning requirement level becomes low by itself even if any image is used as an image to be printed on the recording medium, and cleaning is sufficiently executed corresponding to a reason (for example, ejecting of the ink at a position exceeding the width of the fabric 1) other than the exuding of the ink. On the contrary, since the ink is exuded and is attached to the transporting belt 34 in accordance with image data (in accordance with an amount of the ink applied to the recording medium) in a case of a material in which the ink is exuded to a large extent, it is necessary that necessary and sufficient cleaning be performed in accordance with the assumed cleaning requirement level.

In this manner, the cleaning requirement level and the cleaning execution level corresponding to the cleaning requirement level may be set based on information on the image data and the transmittance obtained by drawing the transmittance of the liquid to the recording medium through inputting information including information on the recording medium and the attribute of the recording medium, information on the liquid and the attribute of the liquid, and the like.

The printing apparatus 100 of Example 3 includes an input section to which the attributes of the recording medium and/or the attributes of the ink are input. Specifically, the attributes of the recording medium and/or the attributes of the ink are input to the control section 70 by an input section of, for example, a personal computer as the control section 70.

The control section 70 has a condition table for drawing the transmittance of an ink to a recording medium by inputting information including attribute information of the recording medium, and attribute information of the ink. The condition table may be configured as a conversion table obtained by performing evaluation to obtain the transmittance using quality of a material assumed to be used as a recording medium and a material corresponding to a configuration specification and using ink assumed to be used for the recording medium.

The configuration specification of a recording medium includes, for example, a weaving method of a fabric (weave density), a weight of the fabric per unit area, and the like. A table for performing estimation and conversion with the weight or the density may be configured by evaluating and obtaining, in advance, the transmittance of the ink respectively corresponding to fabrics having certain configuration specifications.

When printing is performed on the fabric 1, the printing apparatus 100 of Example 3 inputs the attribute information of the fabric 1 and the attribute information of an ink to be used to the control section 70, determines the cleaning execution level by specifying image data to be printed, and causes the cleaning unit 51 to operate in accordance with the determined cleaning execution level. Specifically, the transmittance is obtained from the attribute information of the fabric 1 and attribute information of the ink which are input by using the above-described conversion table, an amount (corresponding to the cleaning requirement level) of the ink exuded from the image data to the transporting belt 34 is calculated to determine the cleaning execution level, and the cleaning unit 51 operates in accordance with the determined cleaning execution level.

As described above, the condition table is not limited to the conversion table for obtaining the transmittance and the cleaning requirement level by performing estimation from pre-evaluated data. For example, the condition table may be a corresponding table of the cleaning requirement level and the cleaning execution level, which is made based on the pre-evaluated data. The corresponding table is a table, specifically, obtained by limiting a recording medium to be used and a type of an ink to be used to being in an assumed range, obtaining corresponding cleaning requirement level in the limited range in advance and associating the cleaning requirement level and the limited range. In this case, the corresponding cleaning requirement level and the corresponding cleaning requirement level cleaning execution level are drawn by inputting the name of the recording medium and the name of the ink to be used and the cleaning unit 51 operates in accordance with the drawn cleaning requirement level and the drawn cleaning execution level.

According to the recording apparatus and the cleaning method of the recording apparatus in the example, it is possible to obtain the following effects.

The printing apparatus 100 of Example 3 includes the input section to which the attribute of the recording medium (for example, fabric 1) and/or the attribute of the liquid (ink) is input, and draws the cleaning requirement level based on the attribute of the recording medium and the attribute of the liquid which are input from the input section and image data recorded on the fabric 1. Since the cleaning requirement level is based on the transmittance of the ink to the fabric 1 and the density (position and amount at the position) of the ink applied to the fabric 1, the number of cleaning units 51 to operate is a numerical value corresponding to an amount of the ink which penetrates the fabric 1 and is exuded to the transporting belt 34. Thus, it is possible to perform cleaning in a necessary and sufficient range. As a result, cleaning of the transporting belt 34 is not performed excessively or wastefully, and rapid deterioration of the surface of the transporting belt 34 or waste of cleaning water or power necessary for cleaning is suppressed.

Embodiment 2

Next, a printing apparatus 100 as a "recording apparatus" according to Embodiment 2 will be described. In the description which will be made, component parts the same as those of the above-described embodiment are denoted by the same reference numerals and repeated description thereof will be omitted.

In the printing apparatus 100 of Embodiment 2, a plurality of cleaning units are disposed respectively in the direction in which the transporting belt 34 moves and in the direction intersecting the direction in which the transporting belt 34 moves.

The printing apparatus 100 of Embodiment 2 includes a cleaning section 500 instead of the cleaning section 50 included in the printing apparatus 100 of Embodiment 1. The cleaning section 500 includes a plurality of cleaning units 510. Each of the cleaning units 510 has cleaning rollers 520, a cleaning tank, a pressing mechanism, and the like (illustration of the cleaning tank and the pressing mechanism is omitted).

Figure 4A:
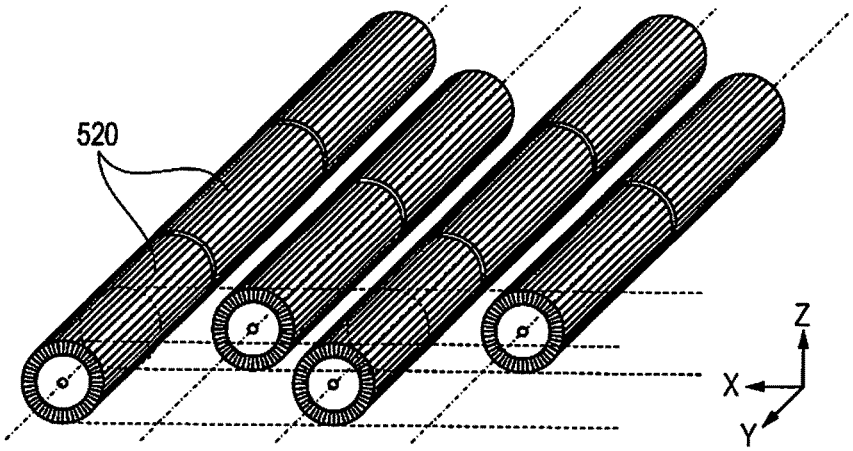
FIG. 4A is a perspective view illustrating cleaning rollers included in a printing apparatus according to Embodiment 2.
Figure 4B:
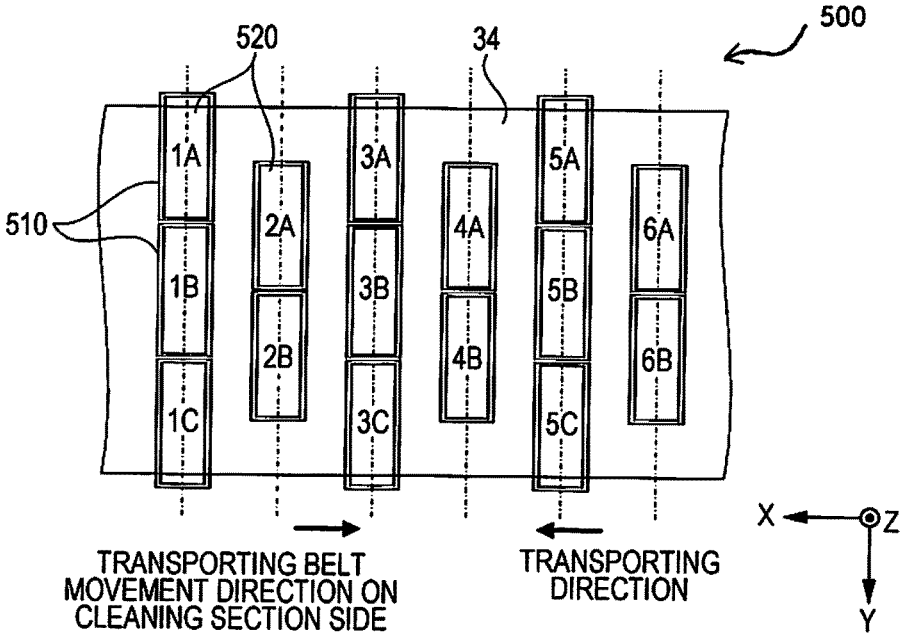
FIG. 4B is a plan view illustrating a disposition of the cleaning rollers.

FIG. 4A is a perspective view illustrating the cleaning rollers 520 and FIG. 4B is a plan view illustrating a disposition of the cleaning rollers 520 and the cleaning units 510.

The cleaning roller 520 has a length shorter than the width of the transporting belt 34. The plurality of cleaning units 510 are disposed in parallel in the width direction of the transporting belt 34.

In the example illustrated in FIG. 4B, the cleaning roller 520 has a length of substantially one third of the width of the transporting belt 34. Three rows (first row, third row, and fifth row) respectively formed of the three cleaning rollers 520 and two rows (second row, fourth row, and sixth row) respectively formed of the two cleaning rollers 520 are alternately disposed such that the cleaning units 510 are disposed in zigzags.

The cleaning units 510 operate independently in accordance with the cleaning requirement level.

In the printing apparatus 100 of Embodiment 2 having such a configuration, the cleaning requirement level and the corresponding cleaning execution level may also be set by various methods. Specific examples will be described below.

Example 4

The printing apparatus 100 of Example 4 is a recording apparatus capable of, in advance, selecting and setting a cleaning unit 510 to operate among the plurality of cleaning units 510. That is, the cleaning section 500 is a recording apparatus which has the most basic configuration and is operated in a manual mode by an operator.

The printing apparatus 100 of Example 4 may set operation/non-operation or the cleaning execution level (intermediate level depending on a difference between the cleaning rollers 520 in a rotating direction, a rotating speed, a pressing force, or the like) among the intermediate levels for every cleaning unit 510.

For example, when the material has quality (transmittance=0) in which exuding of the ink to the back surface of the recording medium is not concerned, cleaning is sufficiently executed corresponding to a reason (for example, ejecting of the ink at a position exceeding the width of the fabric 1) other than the exuding of the ink. In that case, the necessary and sufficient number of cleaning units 510 is operated among the cleaning units 510 at positions of 1A, 3A, 5A, 1C, 3C and 5C in accordance with, for example, the cleaning requirement level in the cleaning units 510 in disposition illustrated in FIG. 4B. Meanwhile, since the ink is exuded and is attached to the transporting belt 34 in accordance with image data (in accordance with a position and an amount of the ink applied to the recording medium) in a case of a material which causes the ink to be exuded to a large extent, the cleaning unit 510 is operated in accordance with the cleaning requirement level at the assumed position.

That is, according to the example, it is possible to independently operate the cleaning units 510 corresponding to the position of contaminants. As a result, cleaning of the transporting belt 34 is not performed excessively or wastefully, and rapid deterioration of the surface of the transporting belt 34 or waste of cleaning water or power necessary for cleaning is suppressed.

Example 5

A printing apparatus 100 of Example 5 has the sensors 80 for detecting the surface state of the transporting belt 34 to be cleaned for every cleaning unit 510 and the cleaning requirement level is based on a result obtained by detecting of the sensors 80, similarly to the cleaning unit 51 of the example 2 illustrated in FIG. 3.

Similarly to Example 2, operation/non-operation of the cleaning unit 510 positioned on the downstream side or the cleaning execution level (intermediate level depending on a difference between the cleaning rollers 520 in a rotating direction, a rotating speed, a pressing force, or the like) is determined among the intermediate levels by using image data achieved by the respective sensors 80.

That is, according to the example, a cleaning unit 510 which is selected in accordance with an attachment state of the ink at a position at which the transporting belt 34 is contaminated operates. Accordingly, it is possible to perform cleaning in a necessary and sufficient range. As a result, cleaning of the transporting belt 34 is not performed excessively or wastefully, and rapid deterioration of the surface of the transporting belt 34 or waste of cleaning water or power necessary for cleaning is suppressed.

Example 6

In a printing apparatus 100 of Example 6, if necessary information is input, a printing apparatus 100 of Example 6 selects the cleaning unit 510 to be cleaned according to a preset condition table. In addition, the printing apparatus 100 of Example 6 determines the cleaning execution level and causes the cleaning unit 510 to operate in accordance with the determined cleaning execution level. The necessary information to be input has the same detail as that described in Example 3.

The printing apparatus 100 of Example 6 includes an input section to which the attribute of a recording medium and/or the attribute of liquid (ink) are input, similarly to Example 3 (printing apparatus 100). Specifically, the attribute of the recording medium and/or the attribute of the ink are input to the control section 70 by an input section of, for example, a personal computer as the control section 70.

The control section 70 has a condition table for drawing the transmittance of the ink to the recording medium by inputting information including attribute information of the recording medium, attribute information of the ink, similarly to Example 3.

The condition table may be a corresponding table described in Example 3.

According to the example, the printing apparatus 100 of Example 6 draws the cleaning requirement level based on the attribute of the recording medium (for example, fabric 1) and the attribute of the liquid (ink) which are input from the input section, and image data recorded on the fabric 1. Since the cleaning requirement level is based on the transmittance of the ink to the fabric 1, and a position and an amount of the ink applied to the fabric 1, the cleaning unit 510 to operate corresponds to the position and the amount of the ink which penetrates the fabric 1 and is exuded to the transporting belt 34. Thus, it is possible to perform cleaning in a necessary and sufficient range. As a result, cleaning of the transporting belt 34 is not performed excessively or wastefully, and rapid deterioration of the surface of the transporting belt 34 or waste of cleaning water or power necessary for cleaning is suppressed.

REFERENCE SIGNS LIST

1 Fabric
10 Recording section
11 Ink ejecting head
12 Nozzle row
20 Supplying section
21 Shaft portion
22 Bearing portion
30 Transporting section
31,32 Transporting rollers
33 Fabric pressing roller
34 Transporting belt
34*a* Support surface
35 Belt rotated roller
36 Belt driving roller
40 Retrieving section
41 Shaft portion
42 Bearing portion
50 Cleaning section
51 Cleaning unit
52 Cleaning roller
52*a* Brush
52*b* Shaft portion
53 Cleaning tank
54 Pressing mechanism
60 Drying section
70 Control section
71 Display unit
80 Sensor
100, 101 Printing apparatus
500 Cleaning section
510 Cleaning unit
520 Cleaning roller
530 Cleaning tank
540 Pressing mechanism

The invention claimed is:

1. A recording apparatus comprising:

a recording section which performs recording by applying liquid to a recording medium;

a transporting belt which transports the recording medium;

a cleaning section which includes a plurality of cleaning units configured to clean the transporting belt, each of the plurality of cleaning units having a same configuration, and each of the plurality of cleaning units including a cleaning roller and a cleaning tank; and a pressing mechanism which supports the cleaning roller and the cleaning tank, and causes the cleaning roller and the cleaning tank to move in a vertical direction to a position in which the cleaning roller does not contact the transporting belt and to stop rotating the cleaning roller, wherein a number of the cleaning units in operation is varied in accordance with a cleaning requirement level, with the cleaning requirement level being based on an attribute of the recording medium or an attribute of the liquid, and the pressing mechanism is configured to vary a pressing force as an intensity of cleaning in accordance with the cleaning requirement level.

2. The recording apparatus according to claim 1, wherein the cleaning requirement level is based on image data recorded on the recording medium.

3. The recording apparatus according to claim 1, wherein the cleaning requirement level is based on a consumption amount of the liquid.

4. The recording apparatus according to claim 1, further comprising:

an input section to which the attribute of the recording medium and/or the attribute of the liquid is input.

5. The recording apparatus according to claim 1, wherein the attribute of the recording medium includes a weight and/or a density of the recording medium and the attribute of the liquid includes a type of the liquid.

6. The recording apparatus according to claim 1, wherein the cleaning section has a sensor of detection a surface state of the cleaned transporting belt, and the cleaning requirement level is based on results obtained by detecting of the sensor.

7. The recording apparatus according to claim 1, wherein the plurality of cleaning units are disposed respectively in a direction in which the transporting belt moves and a direction intersecting the direction in which the transporting belt moves.

8. The recording apparatus according to claim 1, wherein the plurality of cleaning units are three, and the number of the cleaning units in operation is varied such that one of the three cleaning units is operated, two of the three cleaning units are operated, or all of the three cleaning units are operated.

9. A cleaning method of a recording apparatus which includes a recording section performing recording by applying liquid to a recording medium, a transporting belt transporting the recording medium, a cleaning section having a plurality of cleaning units cleaning the transporting belt with each of the plurality of cleaning units having a same configuration and each of the plurality of cleaning units including a cleaning roller and a cleaning tank, and a pressing mechanism supporting the cleaning roller and the cleaning tank, the method comprising:

varying a number of the cleaning units in operation in accordance with a cleaning requirement level, with the cleaning requirement level being based on an attribute of the recording medium or an attribute of the liquid;

causing the cleaning roller and the cleaning tank to move in a vertical direction by the pressing mechanism to a position in which the cleaning roller does not contact the transporting belt and to stop rotating the cleaning roller; and causing the pressing mechanism to vary a pressing force as an intensity of cleaning in accordance with the cleaning requirement level.

10. The cleaning method of a recording apparatus according to claim 9, wherein the plurality of cleaning units are three, and the number of the cleaning units in operation is varied such that one of the three cleaning units is operated, two of the three cleaning units are operated, or all of the three cleaning units are operated.

* * * * *